US005138298A

United States Patent [19]

Shino

[11] Patent Number: 5,138,298

[45] Date of Patent: Aug. 11, 1992

[54] METALLIC OXIDE RESISTIVE BODIES HAVING A NONLINEAR VOLT-AMPERE CHARACTERISTIC AND METHOD OF FABRICATION

[75] Inventor: Kenji Shino, Sakado, Japan

[73] Assignee: Sanken Electric Co., Ltd., Saitama, Japan

[21] Appl. No.: 776,870

[22] Filed: Oct. 16, 1991

Related U.S. Application Data

[63] Continuation of Ser. No. 603,957, Oct. 25, 1990, abandoned.

[30] Foreign Application Priority Data

Nov. 2, 1989 [JP] Japan ..... 1-286788

[51] Int. Cl.[5] ..... H01C 7/10; H01C 17/00

[52] U.S. Cl. ..... 338/21; 252/521; 29/610.1

[58] Field of Search ..... 338/20, 21; 29/610.1; 252/517, 518, 519, 520, 521; 361/117, 126, 127

[56] References Cited

U.S. PATENT DOCUMENTS 4,169,071 9/1979 Eda et al. ..... 338/21 X
4,943,795 7/1990 Yamazcki et al. ..... 338/21

FOREIGN PATENT DOCUMENTS 53-11076 4/1978 Japan .
61-43404 3/1986 Japan .

*Primary Examiner*—Marvin M. Lateef
*Attorney, Agent, or Firm*—Woodcock Washburn Kurtz Mackiewicz & Norris

[57] ABSTRACT

An electrically resistive body best suited for providing varistors of high surge withstanding capability and high nonlinearity coefficient over a wide range of current magnitudes. The resistive body is composed of a major proportion of metallic oxides including zinc oxide, bismuth trioxide, antimony trioxide, cobaltous oxide, magnesium oxide, manganous oxide, and boric oxide. To these major ingredients there are added minor proportions of boric oxide and aluminum oxide, or of boric oxide and spinel. For the fabrication of such resistive bodies, the mixture of the noted ingredients in finely divided form are molded into desired shape and size, and the moldings are sintered.

2 Claims, 5 Drawing Sheets

METALLIC OXIDE RESISTIVE BODIES HAVING A NONLINEAR VOLT-AMPERE CHARACTERISTIC AND METHOD OF FABRICATION

This is a continuation, of application Ser. No. 07/603,957, filed Oct. 25, 1990 now abandon.

BACKGROUND OF THE INVENTION

My invention relates to electrically resistive bodies composed primarily of metallic oxides and to a method of fabricating such resistive bodies. The resistive bodies according to my invention are perhaps best suited for use as varistors by reason of their markedly nonlinear volt-ampere characteristic, although I do not wish my invention to be limited to this particular application.

The varistor is a two-electrode semiconductor device, sometimes referred to as voltage-dependent resistor because of its voltage-dependent nonlinear resistance. It has found extensive use in electronic circuits for the absorption of voltage surges.

I know some semiconductor materials heretofore suggested and used for varistors. For example, Japanese Patent Publication No. 53-11076 proposes the sintered moldings of zinc oxide (ZnO), bismuth trioxide ($Bi_2O_3$), cobaltous oxide (CoO), manganous oxide (MnO), antimony trioxide ($Sb_2O_3$), nickel oxide (NiO) and silica ($SiO_2$). Japanese Unexamined Patent Publication No. 61-43404 discloses varistor compositions explicitly designed for higher antisurge capabilities, comprising ZnO; $Bi_2O_3$; one or more of CoO, MnO, magnesium oxide (MgO), calcium oxide (CaO), strontium oxide (SrO), barium oxide (BaO), NiO, $SiO_2$, tin dioxide ($SnO_2$), titanium dioxide ($TiO_2$), germanium dioxide ($GeO_2$), $Sb_2O_3$, boric oxide ($B_2O_3$) and chromic oxide ($Cr_2O_3$); one or more of ytterbium oxide ($Yb_2O_3$), erbium oxide ($Er_2O_3$), yttrium oxide ($Y_2O_3$), lanthanum oxide ($La_2O_3$), praseodymium oxide ($Pr_2O_3$) and neodymium oxide ($Nd_2O_3$); aluminum oxide ($Al_2O_3$); and lithium oxide ($Li_2O$).

Notwithstanding such known compositions, there have been consistent demands from the electronics and allied industries for varistor materials capable of protecting electronic appliances against higher voltage surges. There have also been demands for varistor materials having a higher volt-ampere nonlinearity coefficient in a wide range of varistor current magnitudes.

SUMMARY OF THE INVENTION

I have hereby invented how to compose resistive bodies that meet such demands, and how to fabricate such resistive bodies.

Briefly, my invention may be summarized as an electrically resistive body having a nonlinear volt-ampere characteristic, consisting essentially of: 100 parts by weight of a set of major ingredients to be set forth subsequently, from about 0.01 to about 0.10 part by weight boron oxide, and from about 0.002 to 0.008 part by weight aluminum oxide. The major ingredients comprise from about 80.0 to about 97.5 mole percent zinc oxide, from about 0.3 to about 3.0 mole percent bismuth oxide, from about 0.3 to about 3.0 mole percent antimony oxide, from about 0.3 to about 3.0 mole percent cobalt oxide, from about 1.0 to about 5.0 mole percent magnesium oxide, from about 0.3 to about 3.0 mole percent manganese oxide, and from about 0.3 to about 3.0 mole percent nickel oxide.

Varistors with their resistive bodies formulated according to my invention are best notable for their high surge withstanding capabilities compared with those of the known oxide varistors, besides being favorable in voltage nonlinearity coefficient and in the constancy of performance in use. The varistors will offer a particularly high nonlinearity coefficient over a wide range of current magnitudes when spinel is employed in substitution for aluminum oxide. Thus, incorporated in electronic appliances, the varistors can effectively protect the semiconductor devices and other parts against both abnormal voltages that may be generated internally and voltage surges from external sources.

In the fabrication of the resistive body according to my invention, the use of boric acid is recommended in place of boron oxide. Used as taught herein, boric acid will make possible the quantity production of resistive bodies in which the minute proportions of the additives are uniformly dispersed and which, in consequence, are uniform in electrical characteristics.

The above and other features and advantages of my invention and the manner of realizing them will become more apparent, and the invention itself will best be understood, from a study of the following description and appended claims, with reference had to the attached drawings.

DETAILED DESCRIPTION

Figure 1:
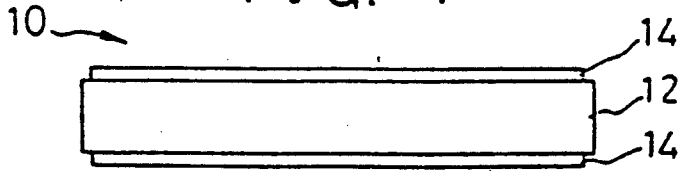
FIG. 1 is an illustration of one of many identical test varistors fabricated in the Examples of my invention to be presented subsequently.

I have illustrated in FIG. 1 one of many test varistors of identical construction fabricated in the subsequent Examples of my invention. Generally designated 10, the representative test varistor has a resistive body 12 of dislike shape, and a pair of electrodes 14 on the opposite faces of the resistive body. The resistive body 12 is a sintered molding of metallic oxides in accordance with my invention. The pair of electrodes 14 may be formed by baking the coatings of silver paste in place on the resistive body 12. However, the expensive silver electrodes are not essential. The resistive body 12 in accordance with my invention has itself a sufficient nonlinearity in volt-ampere characteristic, so that the electrodes 14 may be formed by the vapor deposition of indium, aluminum or tin or by the plating of nickel, rather than by the baking of silver coatings. Whatever the electrode materials, my invention is directed to the novel compositions of the resistive bodies themselves, and to a method of fabricating such resistive bodies.

EXAMPLES 1–48

I fabricated forty-eight different sets of test varistors, each constructed as shown in FIG. 1, some having their resistive bodies formulated in accordance with my invention and others not. Then I proceeded to measure some pertinent electrical properties of the test capacitors in order to determine their utility as varistors. Table 1 list the compositions of the resistive bodies of the test varistors of Examples 1–48.

I have said that the resistive bodies of my invention consist essentially of major ingredients comprising ZnO, $Bi_2O_3$, CoO, MgO, MnO and NiO, and additives comprising $B_2O_3$ and $Al_2O_3$. Accordingly, in Table 1, I have given the various combinations of the relative proportions of the major ingredients, ZnO, $Bi_2O_3$, $Sb_2O_3$, CoO, MgO, MnO and NiO, in mole percent. I have also indicated in Table 1 the amounts of the additives, $B_2O_3$ and $Al_2O_3$, in parts by weight with respect to 100 parts by weight of the major ingredients.

To 100 parts by weight of these major ingredients I added 0.05 part by weight of $B_2O_3$ and 0.003 part by weight of $Al_2O_3$.

Then I ball milled the above mixture of start substances together with 10 parts by weight of water and granulated it. Then I molded the granular material into discs under pressure. Each disc was 12.0 millimeters in diameter and 1.5 millimeters in thickness. Then I air heated the discs to 1250° C. and maintained them at that temperature for one hour, thereby sintering them to maturity. The sintered bodies thus formed are believed to be of substantially the same composition as that before sintering.

TABLE 1

| Test | Compositions | | | | | | | | | Characteristics | | | |
|---|---|---|---|---|---|---|---|---|---|---|---|---|---|
| | Major ingredients (mole percent) | | | | | | | Additives (wt. part) | | | | b | |
| No. | ZnO | $Bi_2O_3$ | $Sb_2O_3$ | CoO | MgO | MnO | NiO | $B_2O_3$ | $Al_2O_3$ | $V_1$ | a | (%) | n |
| 1 | 93.2 | 0.3 | 1.5 | 1.0 | 2.5 | 0.5 | 1.0 | 0.05 | 0.003 | 139 | 50 | −2 | 25–30 |
| 2 | 93.4 | 0.1 | " | " | " | " | " | " | " | 147 | 48 | −5 | 5–10 |
| 3 | 93.0 | 0.5 | " | " | " | " | " | " | " | 135 | 52 | 0 | 35–40 |
| 4 | 91.0 | 2.5 | " | " | " | " | " | " | " | 170 | 63 | 1 | 30–35 |
| 5 | 90.5 | 3.0 | " | " | " | " | " | " | " | 176 | 62 | 1 | 30–35 |
| 6 | 88.5 | 5.0 | " | " | " | " | " | " | " | 190 | 52 | 2 | 10–15 |
| 7 | 93.9 | 1.0 | 0.1 | " | " | " | " | " | " | 105 | 41 | −18 | 10–15 |
| 8 | 93.7 | " | 0.3 | " | " | " | " | " | " | 125 | 49 | −6 | 25–30 |
| 9 | 93.5 | " | 0.5 | " | " | " | " | " | " | 130 | 54 | −2 | 35–40 |
| 10 | 91.5 | " | 2.5 | " | " | " | " | " | " | 177 | 69 | 1 | 30–35 |
| 11 | 91.0 | " | 3.0 | " | " | " | " | " | " | 182 | 67 | 1 | 30–35 |
| 12 | 89.0 | " | 5.0 | " | " | " | " | " | " | 208 | 65 | 3 | 1–5 |
| 13 | 93.4 | " | 1.5 | 0.1 | " | " | " | " | " | 133 | 50 | −3 | 5–10 |
| 14 | 93.2 | " | " | 0.3 | " | " | " | " | " | 142 | 53 | −1 | 25–30 |
| 15 | 93.0 | " | " | 0.5 | " | " | " | " | " | 148 | 56 | 1 | 35–40 |
| 16 | 91.0 | " | " | 2.5 | " | " | " | " | " | 178 | 67 | 2 | 30–35 |
| 17 | 90.5 | " | " | 3.0 | " | " | " | " | " | 180 | 68 | 1 | 25–30 |
| 18 | 88.5 | " | " | 5.0 | " | " | " | " | " | 196 | 70 | −17 | 5–10 |
| 19 | 94.5 | " | " | 1.0 | 0.5 | " | " | " | " | 113 | 43 | −6 | 25–30 |
| 20 | 94.0 | " | " | " | 1.5 | " | " | " | " | 130 | 47 | −4 | 30–35 |
| 21 | 92.5 | 1.0 | 1.5 | 1.0 | 2.5 | 0.5 | 1.0 | 0.05 | 0.003 | 166 | 65 | 1 | 30–35 |
| 22 | 90.0 | " | " | " | 5.0 | " | " | " | " | 190 | 64 | 2 | 20–25 |
| 23 | 85.0 | " | " | " | 10.0 | " | " | " | " | 218 | 61 | 5 | 1–5 |
| 24 | 92.9 | " | " | " | 2.5 | 0.1 | " | " | " | 175 | 46 | −8 | 5–10 |
| 25 | 92.7 | " | " | " | " | 0.3 | " | " | " | 168 | 58 | −2 | 30–35 |
| 26 | 92.5 | " | " | " | " | 0.5 | " | " | " | 165 | 62 | 1 | 35–40 |
| 27 | 90.5 | " | " | " | " | 2.5 | " | " | " | 148 | 60 | 1 | 25–30 |
| 28 | 90.0 | " | " | " | " | 3.0 | " | " | " | 145 | 58 | 1 | 20–25 |
| 29 | 88.0 | " | " | " | " | 5.0 | " | " | " | 138 | 53 | −2 | 10–15 |
| 30 | 93.4 | " | " | " | " | 0.5 | 0.1 | " | " | 150 | 61 | 0 | 10–15 |
| 31 | 93.2 | " | " | " | " | " | 0.3 | " | " | 157 | 62 | 1 | 25–30 |
| 32 | 93.0 | " | " | " | " | " | 0.5 | " | " | 162 | 62 | 1 | 35–40 |
| 33 | 91.0 | " | " | " | " | " | 2.5 | " | " | 175 | 68 | 1 | 30–35 |
| 34 | 90.5 | " | " | " | " | " | 3.0 | " | " | 178 | 68 | 1 | 30–35 |
| 35 | 88.5 | " | " | " | " | " | 5.0 | " | " | 183 | 72 | −1 | 15–20 |
| 36 | 93.0 | " | " | " | " | " | 0.5 | 0.005 | " | 162 | 65 | 1 | 10–15 |
| 37 | " | " | " | " | " | " | " | 0.01 | " | 160 | 66 | 2 | 35–40 |
| 38 | " | " | " | " | " | " | " | 0.025 | " | 157 | 65 | 1 | 45–50 |
| 39 | " | " | " | " | " | " | " | 0.10 | " | 140 | 57 | −2 | 30–35 |
| 40 | " | " | " | " | " | " | " | 0.15 | " | 135 | 56 | −3 | 10–15 |
| 41 | 92.5 | " | " | " | " | " | 1.0 | 0.05 | 0.001 | 160 | 60 | −6 | 3–5 |
| 42 | " | " | " | " | " | " | " | " | 0.002 | 125 | 65 | −4 | 20–25 |
| 43 | " | " | " | " | " | " | " | " | 0.003 | 135 | 70 | −2 | 35–40 |
| 44 | " | " | " | " | " | " | " | " | 0.004 | 145 | 70 | 1 | 35–40 |
| 45 | " | " | " | " | " | " | " | " | 0.005 | 150 | 65 | 1 | 30–35 |
| 46 | " | " | " | " | " | " | " | " | 0.006 | 170 | 57 | 1 | 25–30 |
| 47 | " | " | " | " | " | " | " | " | 0.008 | 200 | 50 | −8 | 15–20 |
| 48 | " | " | " | " | " | " | " | " | 0.010 | 210 | 40 | −30 | 5–10 |

I will now explain how I formulated the test varistors of Test No. 1. I started with the preparation of the major ingredients of the resistive bodies. I prepared the following start materials by the following relative proportions:

| | |
|---|---|
| ZnO | 93.2 mole percent |
| $Bi_2O_3$ | 0.3 mole percent |
| $Sb_2O_3$ | 1.5 mole percent |
| CoO | 1.0 mole percent |
| MgO | 2.5 mole percent |
| MnO | 0.5 mole percent |
| NiO | 1.0 mole percent |

Then I proceeded to the production of the pair of electrodes 14 on each resistive body 12 formulated as above. I coated silver paste on the opposite faces of each disclike resistive body 12 and baked the coatings. Thus I completed the fabrication of the metallic oxide varistors 10 of Test No. 1.

As for the other Examples, designated Tests Nos. 2–48 in Table 1, I made similar test varistors through exactly the same procedure as that set forth above in connection with Test No. 1 except that only the compositions of the resistive bodies 12 were changed as indicated in Table 1.

Then I tested the varistors of Tests Nos. 1–48 as to their Varistor Voltage $V_1$, Voltage Nonlinearity Coefficient a, Percent Voltage Variation b before and after accelerated varistor usage, and Antisurge Capability n. The results were as given also in Table 1. The values given in the table represent averages over ten test varistors made in each Test. I employed the following methods for the measurement of these properties:

Varistor Voltage $V_1$

A current of one milliampere was made to flow through each test varistor, and the resulting voltage between the pair of electrodes 14 was measured.

Voltage Nonlinearity Coefficient a

The voltage $V_{0.1}$ between the pair of electrodes 14 of each test varistor was measured at a current of 0.1 milliampere. The Voltage Non-linearity Coefficient a was then computed from this voltage $V_{0.1}$ and the above varistor voltage $V_1$ by the equation:

$$a = 1/\log(V_{0.1}/V_1).$$

Generally, the higher the Voltage Nonlinearity Coefficient a, the more favorable the varistor is in nonlinearity.

Percent Voltage Variation b

The voltage $V_{0.1}$ of each unused test varistor was first measured at a current of 0.1 milliampere. Then the varistors were introduced into a constant temperature vessel in which the temperature was maintained at 85° C., and therein a direct current of one milliampere was continuously applied to the varistors for 24 hours. Subsequently withdrawn from the vessel, the varistors were measured as to their voltage $V_{0.1}'$ at room temperature. Then the Percent Voltage Variation b before and after the accelerated usage was computed by the equation:

$$b = V_{0.1}'/(V_{0.1} - V_{0.1}') \times 100.$$

The Percent Voltage Variation b is a measure of the useful life of the varistors. The smaller the Variation b, the longer will be the useful life of the varistor.

Antisurge Capability n

The voltage $V_1$ of each test varistor was first measured at a current of one milliampere. Then five consecutive current surges were applied to each test varistor at intervals of 30 seconds. The current surges had a rise time of eight microseconds, a fall time of 20 microseconds, and a peak amplitude of 2500 amperes. Then the voltage $V_1'$ of each test varistor was again measured at a current of one milliampere. Then the percent variation, $[(V_1 - V_1')/V_1] \times 100$, of the varistor voltages $V_1$ and $V_1'$ before and after the surge application was calculated to see if the voltage variation was 10 percent or more.

The Antisurge Capability n represents the number of times the foregoing procedure was repeated until the voltage variation became 10 percent or more. The greater the number n, the better is the varistor in antisurge capability. Table 1 gives the greatest and the smallest numbers of times the above procedure was repeated on the ten test varistors of each Test.

It will be observed from Table 1 that the Varistor Voltages $V_1$ of the ten Test No. 1 varistors, for instance, averaged 139, their Voltage Nonlinearity Coefficients a 50, their Percent Voltage Variations b −2, and their Antisurge Capabilities n ranged from 25 to 30.

Before proceeding further with the examination of the results of Tests Nos. 1–48, I will set up the criteria of acceptability for the varistors manufactured in accordance with my invention. These criteria are:

Antisurge Capability n:
More than 10.

Percent Voltage Variation b:
From −10 to +10 percent.

Voltage Nonlinearity Coefficient a:
More than 40.

A reconsideration of Table 1 in light of the above established criteria of the electrical properties will reveal that the test varistors of Tests Nos. 2, 6, 7, 12, 13, 18, 19, 23, 24, 29, 30, 35, 36, 40, 41 and 48 do not meet these criteria. Accordingly, the corresponding compositions of the resistive bodies fall outside the scope of my invention. The test varistors of all the other Tests satisfy the criteria, so that the compositions of their resistive bodies are in accord with my invention.

Let us now more closely evaluate the results of Table 1. In Tests Nos. 1–6 I fixed the relative proportions of all but ZnO and $Bi_2O_3$ of the major ingredients and the proportions of the additives with respect to the total amount of the major ingredients. Only the proportion of $Bi_2O_3$ was varied in the range of 0.1–5.0 mole percent, and that of ZnO was modified correspondingly in order to maintain the proportions of the other major ingredients unchanged.

Figure 2:
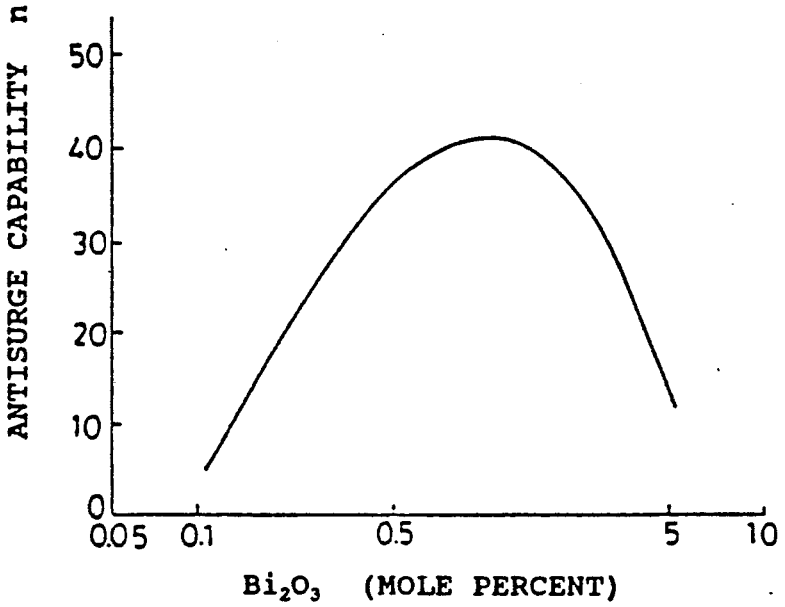
FIGS. 2–10 are graphs plotting the curves of the surge withstanding capabilities of the test varistors against the proportions of the various ingredients of their resistive bodies.

The consequences of such variations in the proportions of $Bi_2O_3$ and ZnO were best manifested by the Antisurge Capabilities n of the resulting test varistors of Tests Nos. 1–6. The test varistors did not meet the Antisurge Capability criterion, more than 10, when the proportion of $Bi_2O_3$ was made less than 0.3 mole percent, as in Test No. 2, and more than 3.0 mole percent, as in Test No. 6. FIG. 2 is a graphic summary of such relationship between the proportions of $Bi_2O_3$ and the Antisurge Capabilities of the resulting test varistors of Tests Nos. 1–6.

I therefore suggest that the proportion of $Bi_2O_3$ be in the range of about 0.3 to about 3.0 mole percent, for the best results about 0.5 to about 2.0 mole percent, for the provision of varistors that can well withstand current surges. The test varistors containing this range of proportions of $Bi_2O_3$ also satisfied the criteria of Voltage Nonlinearity Coefficient a and Percent Voltage Variation b.

In Tests Nos. 7–12 I set the proportion of $Sb_2O_3$ at various values from 0.1 to 5.0 mole percent and correspondingly modified the proportion of ZnO to keep unchanged the proportions of the other major ingredients. The proportions of the additives were also left unchanged.

Figure 3:
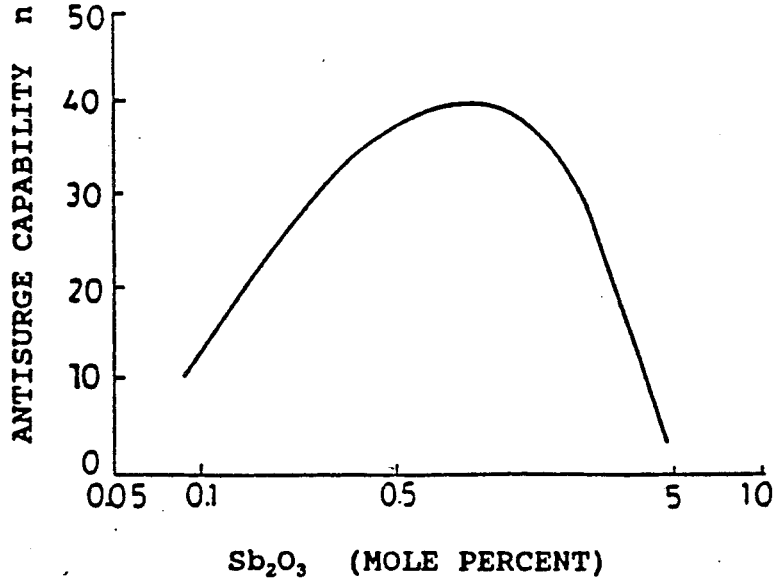

FIG. 3 graphically represents the relationship between the varied proportions of $Sb_2O_3$ and the Antisurge Capabilities n of the resulting varistors of Tests Nos. 7–12. The test varistors did not meet the criterion of Antisurge Capability n when the proportion of $Sb_2O_3$ was made less than 0.3 mole percent, as in Test No. 7, and more than 3.0 mole percent, as in Test No. 12.

Therefore, the acceptable range of proportions of $Sb_2O_3$ is from about 0.3 to about 3.0 mole percent, for the best results from about 0.5 to about 2.0 mole percent, for the provision of varistors of high antisurge capability. As indicated by Tests Nos. 8–11, the varistors containing this range of proportions of $Sb_2O_3$ satisfied all the criteria of Antisurge Capability n, Voltage Nonlinearity Coefficient a and Percent Voltage Variation b.

In Tests Nos. 13–18 I variously determined the proportion of CoO from 0.1 to 5.0 mole percent, with corresponding modifications in the proportion of ZnO to keep unchanged the proportions of the other major ingredients. The proportions of the additives were also left unchanged.

Figure 4:
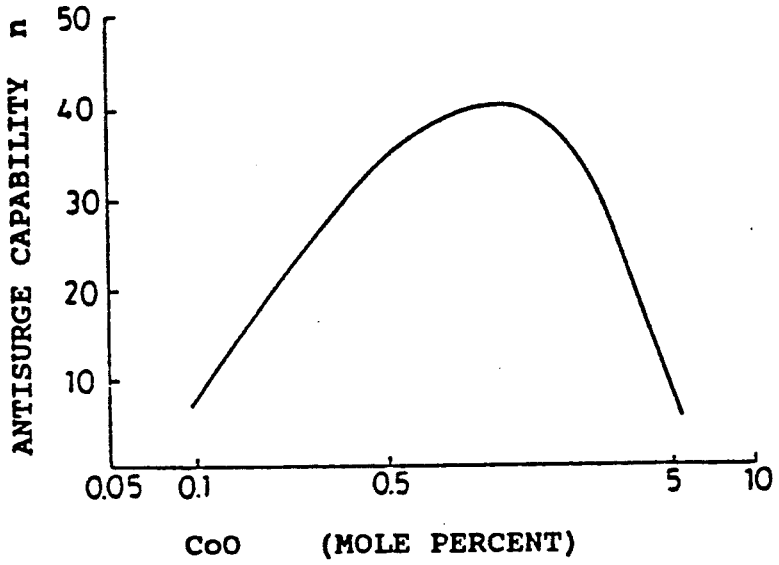

FIG. 4 graphically represents the relationship between the varied proportions of CoO and the Antisurge Capabilities n of the resulting varistors of Tests Nos. 13–18. The test varistors did not meet the Antisurge Capability criterion when the proportion of CoO was made less than 0.3 mole percent, as in test No. 13, and more than 3.0 mole percent, as in Test No. 18.

Therefore, the acceptable range of proportions of CoO is from about 0.3 to about 3.0 mole percent, for the best results from about 0.5 to 2.0 mole percent, for the provision of varistors of high surge withstanding capability. As indicated by Tests Nos. 14–17, the varistors containing this range of proportions of CoO satisfied all the criteria of Antisurge Capability n, Voltage Nonlinearity Coefficient a and Percent Voltage Variation b.

In Tests Nos. 19–23 I varied the proportion of MgO in the range of 0.5–10.0 mole percent, with corresponding modifications in the proportion of ZnO to keep unchanged the proportions of the other major ingredients. The proportions of the additives were also left unchanged.

Figure 5:
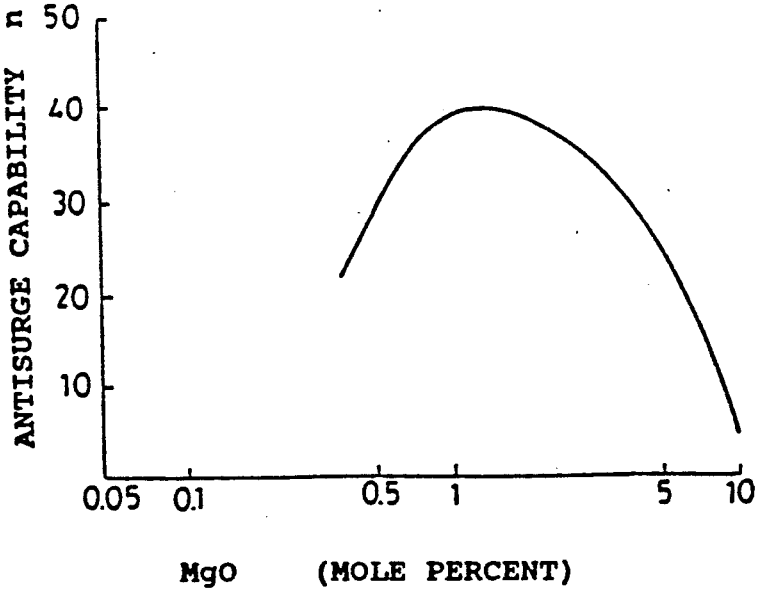

FIG. 5 graphically represents the relationship between the varied proportions of MgO and the Antisurge Capabilities n of the resulting varistors of Tests Nos. 19–23. The test varistors did not meet the Antisurge Capability criterion when the proportion of MgO was made more than 5.0 mole percent, as in Test No. 23. These test varistors also indicated a sharp decrease in Voltage Nonlinearity Coefficient a, when the proportion of MgO was made less than 1.0 mole percent, as in Test No. 19.

Therefore, the acceptable range of proportions of MgO is from about 1.0 to about 5.0 mole percent, for the best results from about 2.0 to about 4.0 mole percent, for the provision of varistors of high antisurge capability and high voltage nonlinearity coefficient. As indicated by Tests Nos. 18–22, the varistors containing this range of proportions of MgO were also favorable in Percent Voltage Variation b.

In Tests No. 24–29 I varied the proportion of MnO in the range of 0.1–5.0 mole percent, with corresponding modifications in the proportion of ZnO to keep unchanged the proportions of the other major ingredients. The proportions of the additives were also left unchanged.

Figure 6:
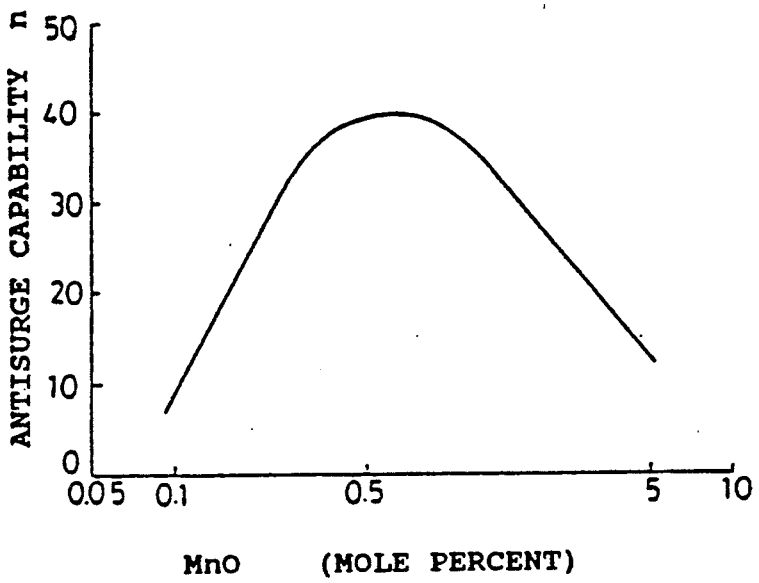

FIG. 6 graphically represents the relationship between the varied proportions of MnO and the Antisurge Capabilities n of the resulting varistors of Tests No. 24–29. The test varistors did not meet the Antisurge Capability criterion when the proportion of MnO was made less than 0.3 mole percent, as in Test No. 24, and more than 3.0 mole percent, as in Test No. 29.

Therefore, the acceptable range of proportions of MnO is from about 0.3 to about 3.0 mole percent, for the best results from about 0.4 to about 1.0 mole percent, for the provision of varistors of high antisurge capability. As indicated by Tests Nos. 25–28, the varistors containing this range of proportions of MnO satisfied all the criteria of Antisurge Capability n, Voltage Nonlinearity Coefficient a and Percent Voltage Variation b.

In Tests Nos. 30–35 I varied the proportion of NiO in the range of 0.1–5.0 mole percent, with corresponding modifications in the proportion of ZnO to keep unchanged the proportions of the other major ingredients. The proportions of the additives were also left unchanged.

Figure 7:
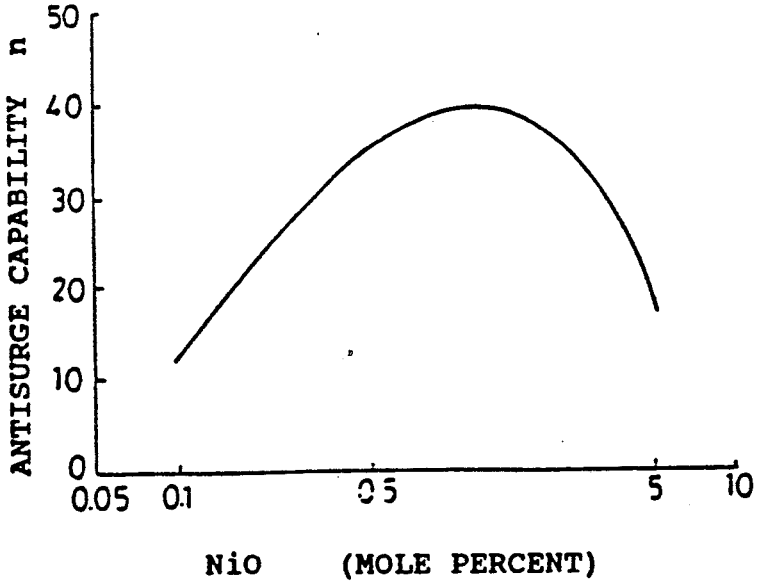

FIG. 7 graphically represents the relationship between the varied proportions of NiO and the Antisurge Capabilities n of the resulting varistors of Tests Nos. 30–35. The test varistors did not meet the Antisurge Capability criterion when the proportion of NiO was made less than 0.3 mole percent, as in Test No. 30, and more than 3.0 mole percent, as in Test No. 35.

Therefore, the acceptable range of proportions of NiO is from about 0.3 to about 3.0 mole percent, for the best results from about 0.5 to about 2.0 mole percent, for the provision of varistors of high antisurge capability. As indicated by Tests Nos. 31–34, the test varistors containing this range of proportions of NiO satisfied all the criteria of Antisurge Capability n, Voltage Nonlinearity Coefficient a and Percent Voltage Variation b.

I carried out Tests Nos. 36–48 in order to ascertain the effects of variations in the proportions of the two additives, $B_2O_3$ and $Al_2O_3$, on the characteristics of the resulting test varistors. First, in Tests Nos. 36–40, I varied the proportion of $B_2O_3$ in the range of 0.005–0.150 weight part with respect to 100 weight parts of the major ingredients. The proportions of all the major ingredients and of the other additive were fixed at the values given.

Figure 8:
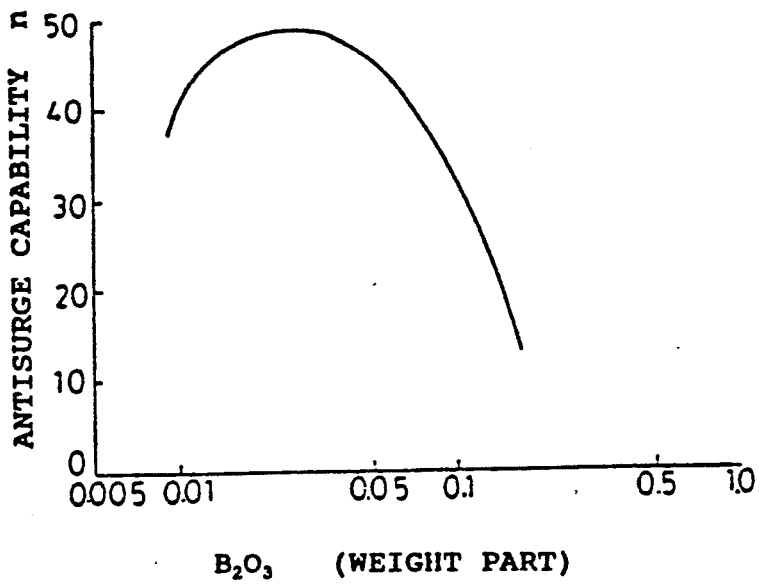

FIG. 8 graphically represents the relationship between the varied proportion of $B_2O_3$ and the Antisurge Capabilities n of the resulting varistors of Tests Nos. 36–40. The test varistors did not meet the Antisurge Capability criterion when the proportion of $B_2O_3$ was made less than 0.01 weight part, as in Test No. 36, and more than 0.1 weight part, as in Test No. 40.

Therefore, the acceptable range of proportions of $B_2O_3$ is from about 0.01 to about 0.10 weight part, for the best results from about 0.02 to about 0.05 weight part, with respect to 100 parts of the major ingredients for the provision of varistors of high antisurge capability. As indicated by Tests Nos. 37–39, the test varistors containing this range of proportions of $B_2O_3$ satisfied all the criteria of Antisurge Capability n, Voltage Nonlinearity Coefficient a and Percent Voltage Variation b.

In Tests Nos. 41–48 I varied the proportion of $Al_2O_3$ in the range of 0.001–0.010 weight part with respect to 100 weight parts of the major ingredients. The proportions of all the major ingredients and of the other additive were fixed at the values given.

Figure 9:
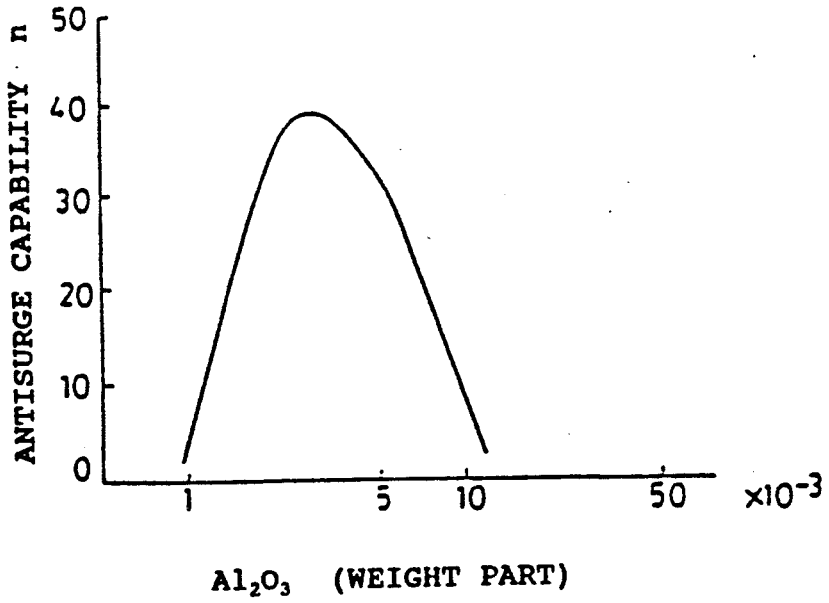

FIG. 9 graphically represents the relationship between the varied proportion of $Al_2O_3$ and the Antisurge Capabilities n of the resulting varistors of Tests Nos. 41–48. The test varistors did not meet the Antisurge Capability criterion when the proportion of $Al_2O_3$ was made less than 0.002 weight part, as in Test No. 41, and more than 0.008 weight part, as in Test No. 48.

Therefore, the acceptable range of proportions of $Al_2O_3$ is from about 0.002 to about 0.008 weight part, for the best results from about 0.003 to about 0.006 weight part, with respect to 100 weight parts of the major ingredients for the provision of varistors of high antisurge capability. As indicated by Tests Nos. 42–47, the test varistors containing this range of proportions of $Al_2O_3$ satisfied all the criteria of Antisurge Capability n, Voltage Nonlinearity Coefficient a and Percent Voltage Variation b.

EXAMPLES 49-56

In these Examples I fabricated eight different sets of test varistors, also each constructed as shown in FIG. 1, through the same procedure as in Examples 1–48 except that I substituted spinel ($MgAl_2O_4$) for $Al_2O_3$ in Tests Nos. 41–48. Then I measured the four electrical properties of the test varistors by the same methods as set forth above. Table 2 gives the resistive body compositions and the electrical characteristics of the test varistors of Examples 49–56.

TABLE 2

| Test No. | Compositions: Major ingredients (mole percent) ZnO | $Bi_2O_3$ | $Sb_2O_3$ | CoO | MgO | MnO | NiO | Additives (wt. part) $B_2O_3$ | $MgAl_2O_4$ | Characteristics $V_1$ | a | b (%) | n |
|---|---|---|---|---|---|---|---|---|---|---|---|---|---|
| 49 | 92.5 | 1.0 | 1.5 | 1.0 | 2.5 | 0.5 | 1.0 | 0.05 | 0.0014 | 160 | 60 | −6 | 3–5 |
| 50 | " | " | " | " | " | " | " | " | 0.0028 | 125 | 65 | −4 | 20–25 |
| 51 | " | " | " | " | " | " | " | " | 0.0042 | 135 | 70 | −2 | 35–40 |
| 52 | " | " | " | " | " | " | " | " | 0.0056 | 145 | 70 | 1 | 35–40 |
| 53 | " | " | " | " | " | " | " | " | 0.0070 | 150 | 65 | 1 | 30–35 |
| 54 | " | " | " | " | " | " | " | " | 0.0084 | 170 | 57 | 1 | 25–30 |
| 55 | " | " | " | " | " | " | " | " | 0.0112 | 200 | 50 | −8 | 15–20 |
| 56 | " | " | " | " | " | " | " | " | 0.0140 | 210 | 40 | −30 | 5–10 |

As indicated by Table 2, I set the proportion of $MgAl_2O_4$ at various values between 0.0014 and 0.0140 part by weight with respect to 100 parts by weight of the major ingredients. The proportion of the other additive, $B_2O_3$, and the proportions of all the major ingredients were the same as in Tests Nos. 41–48.

Figure 10:
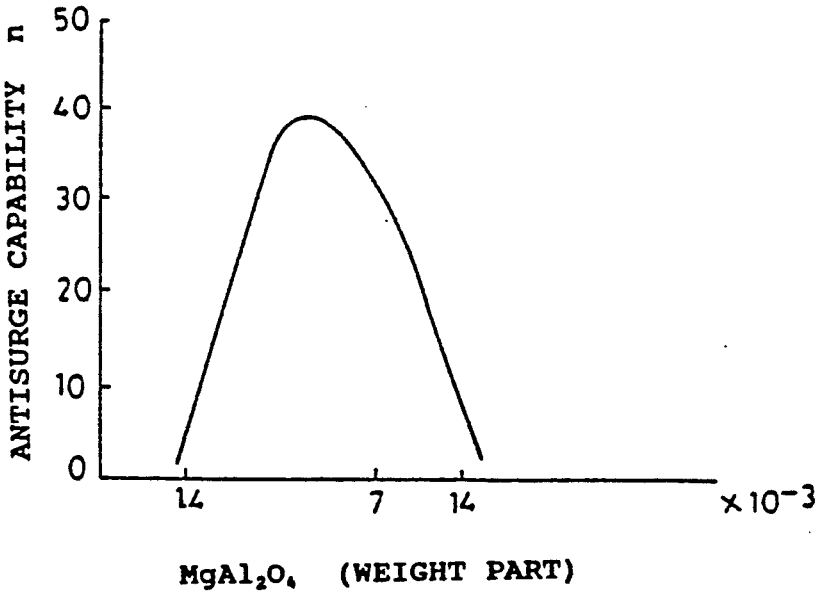

FIG. 10 graphically represents the relationship between the varied proportions of $MgAl_2O_4$ and the Antisurge Capabilities n of the resulting varistors of Tests Nos. 49–56. The test varistors fell short of the Antisurge Capability criterion, more than 10, when the proportion of $MgAl_2O_4$ was made less than 0.0028 part by weight, as in Test No. 49, and more than 0.0112 part by weight, as in Test No. 56.

Accordingly, the acceptable range of proportions of $MgAl_2O_4$ is from about 0.0028 to 0.0112 part by weight, for the best results from about 0.0042 to about 0.0070 part by weight, for the provision of varistors of high antisurge capability. As shown by Tests Nos. 50–55, the varistors containing this range of proportions of $MgAl_2O_4$ satisfied all the criteria of Antisurge Capability n, Voltage Nonlinearity Coefficient a and Percent Voltage Variation b.

Experiment has proved that $MgAl_2O_4$, used as above in Tests Nos. 49–56, serves the additional purpose of increasing the Voltage Nonlinearity Coefficient a of the varistors when the current magnitude is relatively low. In order to prove this effect, I measured the voltages $V_{0.1}$ and $V_{0.001}$ of the test varistors of Tests Nos. 49–56 at current magnitudes of 0.1 and 0.001 milliampere, respectively. Then I calculated the Voltage Nonlinearity Coefficient a' of the test varistors by the equation:

$$a' = 1/\log (V_{0.1}/V_{0.001}).$$

The Voltage Nonlinearity Coefficients a' of the Tests Nos. 49–56 varistors were 75, 63, 52, 42, 34, 29, 23, and 19, respectively. I also calculated the Voltage Nonlinearity Coefficient a' of the Tests Nos. 41–48 varistors in which $Al_2O_3$ was employed in place of $MgAl_2O_4$. The Voltage Nonlinearity Coefficient a' of these test varistors were 63, 47, 35, 30, 25, 18, 12 and 7, repectively. It will be appreciated that the use of $MgAl_2O_4$ in place of $Al_2O_3$ resulted in substantial improvement in Voltage Nonlinearity Coefficient a' in a low current range. I have also confirmed by experiment that similarly favorable Voltage Nonlinearity Coefficient a' is obtainable by suitably selecting the proportions of the other additive, $B_2O_3$, and the major ingredients.

EXAMPLE 57

The proportions of the additives, $B_2O_3$ and $Al_2O_3$ or $MgAl_2O_4$, are so small compared with the total amount of the major ingredients that it might be considered difficult to form the resistive bodies of my invention in which the additives were uniformly dispersed. I suggest the following method for the elimination of this difficulty. This method is directed to the fabrication of test varistors 10 by the composition of Test No. 44, which composition is purely by way of example.

I first prepared the following start substances by the following relative proportions:

| | |
|---|---|
| ZnO | 92.5 mole percent |
| $Bi_2O_3$ | 1.0 mole percent |
| $Sb_2O_3$ | 1.5 mole percent |
| CoO | 1.0 mole percent |
| MgO | 2.5 mole percent |
| MnO | 0.5 mole percent |
| NiO | 1.0 mole percent |

I also prepared a boric acid ($H_3BO_3$) solution by dissolving 0.0281 part by weight of boric acid in heated water. Then I added 0.004 part by weight of $Al_2O_3$ in finely divided form and four parts by weight of an organic binder to the boric acid solution. Then I added this aqueous mixture ($Al_2O_3$ is insoluble in water) to 100 parts by weight of the above prepared major ingredients. Then I stirred the admixture. Thereafter I followed the procedure of Examples 1–48 to form test varistors 10. The fact that the minute amounts of the additives were uniformly dispersed in the resistive bodies of the test varistors 10 could be confirmed by the uniformity of the characteristics of the test varistors.

EXAMPLE 58

I followed the procedure of Example 58 to fabricate test varistors 10 with the composition of Test No. 52 given in Table 2, adding $MgAl_2O_4$, instead of $Al_2O_3$, to the boric acid solution. The test varistors thus produced were just as favorable in the uniformity of their characteristics. Additional experiment with the other compositions of my invention has proved that the use of the boric acid solution results in the provision of varistors of equally unvarying characteristics.

POSSIBLE MODIFICATIONS

Although I have disclosed my invention in very specific aspects thereof, I do not wish my invention to be limited by the exact details of such disclosure. The following, then, is a brief list of possible modifications or alterations of the foregoing disclosure that will readily occur to the specialists without departing from the scope of my invention:

1. The hydroxides, carbonates, fluorides, etc., instead of oxides, of the noted elements could be employed as start substances for the fabrication of resistive bodies according to my invention, as such compounds will be oxidized on sintering. Thus, for instance, $CoCO_3$, $MgCO_3$, and $MnCO_3$ might be employed in places of CoO, MgO and MnO.

2. The sintering temperature could be anywhere between 1200° and 1350° C., and the sintering time between 30 minutes and 120 minutes.

3. In intimately intermingling the major ingredients and the additives, there could be first prepared a mixture of the major ingredients and $Al_2O_3$ or $MgAl_2O_4$, followed by the introduction of this mixture into an aqueous solution of 0.0056 to 0.0563 part by weight $H_3BO_3$.

4. The amount of water used in intermingling and granulating the major ingredients the additives could be anywhere between 50 and 150 parts by weight.

What I claim is:

1. A method of fabricating a resistive body having a nonlinear volt-ampere characteristic, which comprises:

(A) providing 100 parts by weight of a set of major ingredients comprising:

(a) from about 80.0 to about 97.5 mole percent zinc oxide;

(b) from about 0.3 to about 3.0 mole percent bismuth oxide;

(c) from about 0.3 to about 3.0 mole percent antimony oxide;

(d) from about 0.3 to about 3.0 mole percent cobalt oxide;

(e) from about 1.0 to about 5.0 mole percent magnesium oxide;

(f) from about 0.3 to about 3.0 mole percent manganese oxide; and (g) from about 0.3 to about 3.0 mole percent nickel oxide;

(B) providing an aqueous mixture of from about 0.0056 to about 0.05663 part by weight boric acid and from about 0.0028 to about 0.0112 part by weight $MgAl_2O_4$;

(C) forming a mixture of the major ingredients and the aqueous mixture;

(D) forming the mixture of the major ingredients and the aqueous mixture into a molding; and (E) sintering the molding.

2. A method of fabricating a resistive body having a nonlinear volt-ampere characteristic, which comprises:

(A) providing 100 parts by weight of a set of major ingredients comprising:

(a) from about 80.0 to about 97.5 mole percent zinc oxide;

(b) from about 0.3 to about 3.0 mole percent bismuth oxide;

(c) from about 0.3 to about 3.0 mole percent antimony oxide;

(d) from about 1.0 to about 5.0 mole percent magnesium oxide;

(e) from about 0.3 to about 3.0 mole percent manganese oxide; and (f) from about 0.3 to about 3.0 mole percent nickel oxide;

(B) preparing a boric acid solution by dissolving a boric acid in heated water;

(C) providing an aqueous mixture of from about 0.0056 to about 0.0563 part by weight boric acid and from about 0.0028 to about 0.0112 part by weight $MgAl_2O_4$ by adding $MgAl_2O_4$ to the boric acid solution (D) forming a mixture of the major ingredients and the aqueous mixture;

(E) forming the mixture of the major ingredients and the aqueous mixture into a molding; and (F) sintering the molding.

* * * * *